United States Patent [19]

Wei

[11] Patent Number: 4,942,744

[45] Date of Patent: Jul. 24, 1990

[54] SELF-SHINING ARTIFICIAL JEWELRY DEVICE

[76] Inventor: Hsu C. Wei, Rm. 602, 6F, No. 75, Roosevelt Rd., Sec. 2 Taipei, Taiwan

[21] Appl. No.: 306,519

[22] Filed: Feb. 3, 1989

[51] Int. Cl.[5] ..... A44C 17/02

[52] U.S. Cl. ..... 63/26; 63/32; 63/1.1; 63/15

[58] Field of Search ..... 63/26, 27, 32, 1.1, 63/2, 15

[56] References Cited

U.S. PATENT DOCUMENTS

| | | | |
|---|---|---|---|
| 1,812,058 | 6/1931 | Paul | 63/32 X |
| 1,941,782 | 1/1934 | Bager | 63/26 X |
| 2,270,210 | 1/1942 | Barbieri | 63/32 |
| 2,270,270 | 1/1942 | Clare | 63/32 |
| 3,521,049 | 7/1970 | Young | 63/32 X |
| 3,814,926 | 6/1974 | Frasca | 63/32 |

FOREIGN PATENT DOCUMENTS

| | | | |
|---|---|---|---|
| 642585 | 8/1928 | France | 63/26 |
| 1045399 | 10/1966 | United Kingdom | 63/26 |

*Primary Examiner*—Laurie K. Cranmer

*Attorney, Agent, or Firm*—Balough, Osann, Kramer, Dvorak, Genova & Traub

[57] ABSTRACT

It is a self-shining artificial jewelry device, which mainly comprises a piece of artificial jewel having a cavity, an illuminating element being mounted inside the cavity, of which the inner surface is furnished with a plurality of facets. The outer facets of the artificial jewel are coated with a colored coating. When the illuminating element is lighted up, the light will be reflected repeatedly through the inner facets, the outer facets, and the colored coating to generate a brilliant and splendid shining; this jewelry device may be used to replace the expensive jewels and the natural crystal elements, which are deemed to have poor shining result.

2 Claims, 2 Drawing Sheets

SELF-SHINING ARTIFICIAL JEWELRY DEVICE

BACKGROUND OF THE INVENTION

The present invention provides a self-shining artificial jewelry device, which mainly comprises an artificial jewel having a plurality of facets both inside and outside thereof; the outer surface thereof is coated with a brilliant color Film, while the inside of the artificial jewel is mounted with a small bulb or LED to emit light, which is then repeatedly reflected through the facets and the brilliant color Film so as to generate a splendid shining result. The present invention can make a breakthrough shining result in comparison with the conventional crystal lamp and the conventional artificial jewel.

From the ancient time, people like jewels, which not only is used as a means to maintain the value of one's property, but also is treasured by people because of the splendid shining; therefore, people use it as an ornament. Some people would like to use an artificial jewel to make a lamp. However, either a real jewel or an artificial jewel can not generate splendid shining result, if it is placed in a space where has no light; consequently, someone has developed a self-shining artificial jewel, i.e., a small bulb or LED is mounted inside the artificial jewel, whereby the artificial jewel can shine even in the dark. This development has improved the drawback of a jewel, but the reflecting result is still not as brilliant as being expected because of the inner surface of the illuminating element being substantially a smooth curved surface, i.e., the light emitted out of the illuminating element is directly refracted through the outer facets of the jewel; the shining looks beautiful, but not the best. The structure of the crystal lamps available on the market is that it mainly comprises a bulb to emit light and a plurality of small crystal pendants connected in series being mounted around the bulb in a dependent manner. When the bulb is lighted up, the light emitted out will be refracted through the crystal pendants to provide a beautiful glittering result. Aside from the high price unable to be afforded by the average public, the crystal lamp has another drawback, i.e., the light of the bulb is unable to reach every crystal pendants, and therefore it would not provide a perfect shining result.

In view of the aforesaid drawbacks of the conventional jewels and the crystal lamps, the inventor has developed a self-shining artificial jewelry device, in which the refraction of light and the light source are specially designed. In this device, the artificial jewel has its original outer facets, and is coated with a brilliant color film thereon; the inside cavity of the artificial jewel is mounted with a bulb or a LED; further, the inner surface of the cavity is furnished with a plurality of facets, whereby the light can be refracted repeatedly through the facets and the brilliant color film to provide a splendid shining result, which is incomparable with that of the conventional crystal lamp and the conventional jewel; in addition, the manufacturing cost of the present invention is much lower than that of the conventional crystal lamp and the jewel, and therefore it is deemed a novel disclosure.

SUMMARY OF THE INVENTION

The present invention relates to a self-shining artificial jewelry device, which is made by means of refracting effect of light through a plurality of facets on the artificial jewel. The artificial jewel has an empty cavity, of which the inner surface is furnished with a plurality of facets. An illuminating element is mounted in the cavity, and when the illuminating element is lighted up, the light thereof will be refracted by the facets in the cavity, and reflected by the outer facets with colored coating to generate a beautiful and splendid shining result.

DETAILED DESCRIPTION

From the ancient time to the modern world, people always like shining and beautiful jewels; for instance, the crystal lamp is considered an expensive lamp; the jewel and the crystal are considered expensive precious stones, but none of them can give light by itself; however, each of them can reflect the light from an external illuminating source. When the external illuminating source throws a strong light to a precious stone, that precious stone will reflect a brilliant light; otherwise, the precious stone reflects no light at all. In order to improve the drawbacks of the precious stones the inventor has developed "A Self-shining Artificial Jewelry Device".

The present invention is further described in detail with the accompanying drawings.

Figure 1:
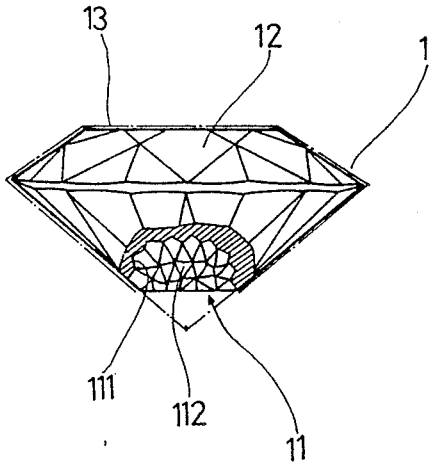
FIG. 1 is a fragmental sectional view of an embodiment according to the present invention.

Referring to FIG. 1, there shows a fragmental sectional view of an embodiment according to the present invention, in which the major feature being distinguished from the conventional jewels and the decorative lamps is that a plurality of reflecting facets 112 are furnished on the inner wall surface 111 of the illuminating element cavity 11. When light is reflected from the reflecting facet 112 through various facets 12 and the brilliant color film 13, many brilliant color beams will be shone in different directions.

Figure 2:
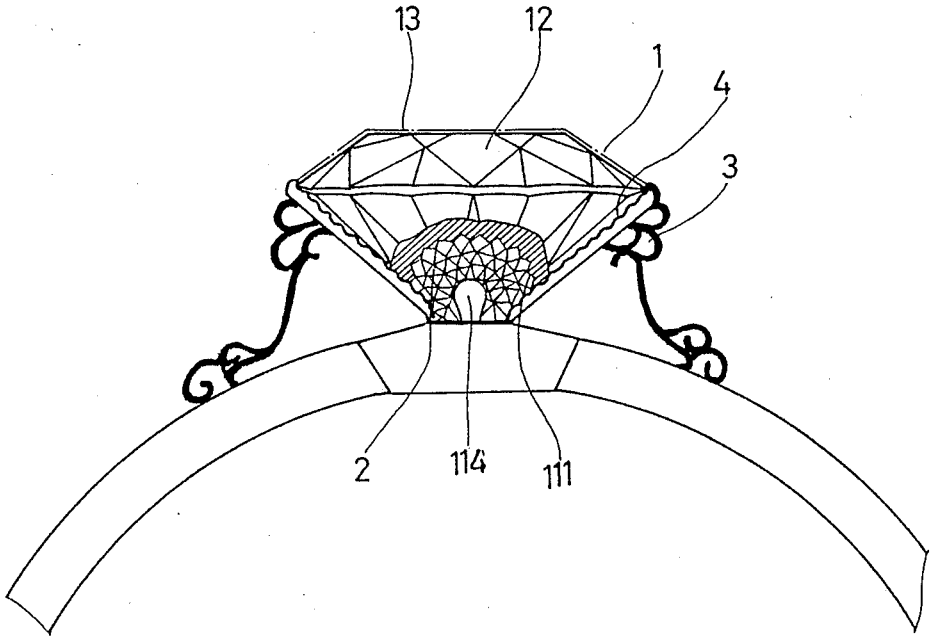
FIG. 2 is a sectional view of the embodiment according to the present invention.

FIG. 2 illustrates a sectional view of the embodiment of the self-shining artificial jewelry device according to the present invention. When the embodiment of the present invention is mounted on a finger ring, a bracelet, an earring or other ornaments, the socket portion 3 may be mounted with a reflecting surface 4 to reflect the light generated by the illuminating element among the inner wall surface 111, the facets, and the brilliant color film 13 so as to obtain a beautiful glittering result through repeated refraction.

Figure 3A:
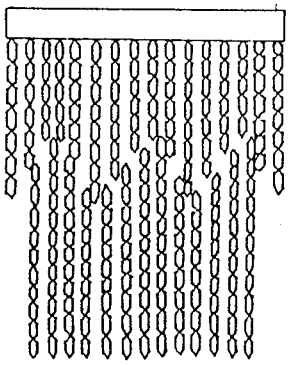
FIG. 3 is an enlarged sectional view of another embodimet according to the present invention.
Figure 3B:
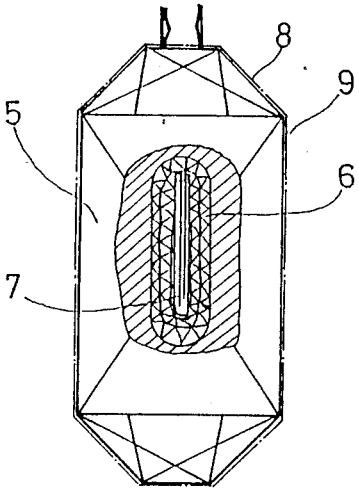

FIG. 3 illustrates another embodiment of the present invention, which is an enlarged sectional view, being used as crystal elements 9 to be mounted in a crystal lamp instead of using the real crystal elements. In each of the crystal elements 9, there is an illuminating element 7, of which the light is reflected by the inner facets 6, the outer facets 5, and the colored coating 8 to generate a splendid shining result through repeated refraction.

Figure 4:
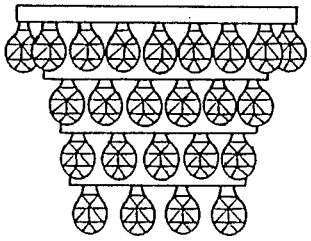
FIG. 4 is still another embodiment according to the present invention.

FIG. 4 illustrates still another embodiment according to the present invention.

Briefly, the self-shining artificial jewelry device can be mounted in a small finger ring or in a large chandelier lamp, and therefore it is deemed a novel and ornament device.

I claim:

1. A sparkling jewelry device comprising a jewel having a cavity therein, said cavity having an inner surface provided with a plurality of light-reflecting facets, said jewel having an exterior surface provided with a plurality of light-reflecting facets, a colored coating disposed over said exterior light-reflecting facets, and a light-generating element disposed in said cavity for directing light rays upon both of said light-reflecting facets and through said colored coating; and a socket for mounting said jewel and said light-generating element, said socket having a plurality of corrugated reflective surfaces for reflecting additional light rays toward both of said light-reflecting facets.

2. A jewelry device as claimed in claim 1, wherein said socket forms a part of a ring.

* * * * *